US009822599B2

(12) United States Patent
Saheta et al.

(10) Patent No.: US 9,822,599 B2
(45) Date of Patent: Nov. 21, 2017

(54) PRESSURE LOCK FOR JARS

(71) Applicant: Smith International, Inc., Houston, TX (US)

(72) Inventors: Vishal Saheta, Houston, TX (US); Richard David Peer, Katy, TX (US); Brian Mohon, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/882,692

(22) Filed: Oct. 14, 2015

(65) Prior Publication Data

US 2016/0032673 A1 Feb. 4, 2016

Related U.S. Application Data

(62) Division of application No. 13/607,088, filed on Sep. 7, 2012, now Pat. No. 9,181,770.

(60) Provisional application No. 61/531,868, filed on Sep. 7, 2011.

(51) Int. Cl.
*E21B 31/113* (2006.01)
*E21B 31/107* (2006.01)

(52) U.S. Cl.
CPC ..... *E21B 31/1135* (2013.01); *E21B 31/107* (2013.01); *E21B 31/113* (2013.01)

(58) Field of Classification Search
CPC .... E21B 34/00; E21B 31/113; E21B 31/1135; E21B 31/107; E21B 34/10; E21B 2034/002; E21B 43/26; E21B 33/134; E21B 33/1285
See application file for complete search history.

(56) References Cited

U.S. PATENT DOCUMENTS

| | | | | |
|---|---|---|---|---|
| 4,111,271 | A | 9/1978 | Perkins | |
| 4,261,427 | A | 4/1981 | Sutliff et al. | |
| 4,293,038 | A | 10/1981 | Evans | |
| 4,332,267 | A | 6/1982 | Evans | |
| 4,738,431 | A | 4/1988 | Perkins | |
| 4,967,844 | A | 11/1990 | Brooks et al. | |
| 5,174,393 | A * | 12/1992 | Roberts | E21B 31/113 166/178 |
| 5,431,221 | A | 7/1995 | Roberts et al. | |
| 5,447,196 | A | 9/1995 | Roberts | |
| 5,503,228 | A | 4/1996 | Anderson | |
| 5,526,888 | A | 6/1996 | Gazewood | |
| 5,595,244 | A | 1/1997 | Roberts | |
| 5,595,253 | A | 1/1997 | Martin et al. | |
| 6,230,811 | B1 | 5/2001 | Ringgenberg et al. | |
| 6,338,387 | B1 | 1/2002 | Mouton et al. | |

(Continued)

OTHER PUBLICATIONS

International Search Report and Written Opinion issued in corresponding International Application No. PCT/US2012/054223; Dated Mar. 22, 2013 (12 pages).

(Continued)

*Primary Examiner* — Yong-Suk (Philip) Ro

(57) ABSTRACT

A jar includes the following: a mandrel; an outer housing slidably disposed about the mandrel; a low pressure chamber having a first port and formed between the mandrel and the outer housing; a high pressure chamber having a second port and formed between the mandrel and the outer housing; a fluid passage between the first and second port; and a valve disposed in the fluid passage.

17 Claims, 9 Drawing Sheets

(56) References Cited

U.S. PATENT DOCUMENTS

| | | | | |
|---|---|---|---|---|
| 6,439,305 | B1 | 8/2002 | Bakke | |
| 6,712,134 | B2 * | 3/2004 | Stoesz | E21B 31/113 166/178 |
| 7,066,251 | B2 | 6/2006 | Streater et al. | |
| 2004/0045716 | A1 | 3/2004 | Bakke | |
| 2010/0089595 | A1 | 4/2010 | Green | |
| 2011/0030976 | A1 | 2/2011 | King | |
| 2013/0168090 | A1 | 7/2013 | Themig et al. | |

OTHER PUBLICATIONS

Office Action issued in U.S. Appl. No. 13/607,088; Dated Oct. 20, 2014 (9 pages).
Office Action issued in U.S. Appl. No. 13/607,088; Dated Mar. 16, 2015 (6 pages).
International Preliminary Report on Patentability issued in International Patent Application No. PCT/US2012/054223 dated Mar. 20, 2014, 8 pages.

* cited by examiner

PRESSURE LOCK FOR JARS

This application is as divisional of U.S. patent application Ser. No. 13/607,088, filed on Sep. 7, 2012, which claims the benefit of the following application under 35 U.S.C. 119(e): U.S. Provisional Application Ser. No. 61/531,868, filed on Sep. 7, 2011. The disclosures of these applications are incorporated by reference in their entireties herein.

BACKGROUND

In the art of drilling wells for recovery of hydrocarbons, the process incorporates a drill string which has a plurality of threaded tubular members such as drill pipe being approximately 30 foot each in length, the drill pipe threaded end to end which is then used to rotate the drill bit either from the surface or through the use of a drill motor which would rotate the bit without the rotation of the drill pipe itself. Often times during that process, the drill string will become lodged at a certain point along its length within the borehole.

In the efforts to dislodge the drill pipe or other tools lodged downhole, a type of tool known as a jarring tool would be used in such an attempt. In the current state of the art, jarring tools may be utilized to either jar the stuck or the lodged portion of pipe either in the up or down direction, depending on the makeup of the tool. In most cases, it would be more desirable to jar down on the pipe than to jar up. The reason for this is that drill pipe will usually get lodged when it is being pulled up as opposed to being moved downward, so jarring downward will more likely free the pipe. In such a case, the pipe is probably wedged against an obstruction caused by the upper movement of the pipe, and jarring upward may tend to wedge the debris around the section of pipe even tighter.

Methods of downward jarring which are currently used in the art include applying compression on the drill string to which a down jar has been attached, whereby the jar releases at a pre-set load, allowing the hammer of the jar to freely travel a short distance impacting the anvil of the tool, delivering a downward blow. The effectiveness of this method has limitations, due to compressional buckling of the drill string, as well as drag. Therefore, it is often difficult to achieve a large downhole jarring force in a vertical well, and the problem is exacerbated in the horizontal portion of a directional drilling operation. A jar in the upward direction can be attached to the top of the stuck pipe or tool, and the jar can be pulled upward until it is tripped. While this type of jarring can produce more force than downward jarring, it is typically in the wrong direction for most instances of stuck pipe. Typically, in oilfield drilling operations, when a drill bit and/or drill string becomes stuck, a jar that is coupled to the drill string may be used to free the drill bit and/or the drill string. The jar is a device used downhole to deliver an impact load to another downhole component, especially when that component is stuck. There are two primary types of jars, hydraulic and mechanical. While their respective designs are different, their operation is similar. Energy is stored in the drillstring and suddenly released by the jar when it fires, thereby imparting an impact load to a downhole component. Jars may also be used to recover stuck drill string components during drilling or workover operations Drilling jars typically have a sliding mandrel in a sleeve. In use, the mandrel is driven up or down by some form of stored energy, a hammer on the mandrel striking an anvil on the sleeve so as to impart a shock and (it is hoped) free the stuck pipe. One common form of drilling jar is a hydraulic jar. A hydraulic jar includes two reservoirs of hydraulic fluid separated by a valve. When tension or compression is applied to the tool in a cocked position, fluid from one chamber is compressed and passes through the valve at high flow resistance into the second chamber. This allows the tool to extend or contract. When the stroke reaches a certain point, the compressed fluid is allowed to suddenly bypass the valve. The jar trips as the fluid rushes into the second chamber, instantly equalizing pressure between the two chambers and allowing the hammer to strike the anvil. The greater the force on the jar, the sooner and more forceful the release.

As jars are returned to the surface after use and/or placed in a derrick, jars may accidentally fire. Such accidental firing can result in significant safety hazards at a drilling location. Traditionally, in an attempt to prevent accidental firing, an external jar clamp is manually placed on a shaft of the jar located between the internal mandrel assembly and the external cylinder assembly. The clamp acts as an external stop that would prevent axial movement of the tool. However, in the event the external clamp was not properly fastened to the jar, the clamp could fall off of the jar during storage, thereby creating a falling object hazard at the drilling location.

In certain situations, internal mechanical latches have also been used in an attempt to prevent accidental firing of the jar. However, internal mechanical latches result in additional steps prior to firing a jar, increasing operational complexity and may unlatch if a load is accidentally exceeded on the rig floor.

Accordingly, safety mechanisms for jars to prevent accidental firing may be desired.

SUMMARY OF THE DISCLOSURE

In one aspect, embodiments disclosed herein relate to a jar including the following: a mandrel; an outer housing slidably disposed about the mandrel; a ball stop housing disposed below the outer housing; a lower sub disposed below the ball stop housing; and a ball stop assembly disposed in the ball stop housing. The ball stop assembly includes a ball stop pivotally disposed in the ball stop assembly.

In another aspect, embodiments disclosed herein relate to a jar including the following: a mandrel; an outer housing slidably disposed about the mandrel; a low pressure chamber having a first port and formed between the mandrel and the outer housing; a high pressure chamber having a second port and formed between the mandrel and the outer housing; a fluid passage between the first and second port; and a valve disposed in the fluid passage. The valve may be a needle valve or a seal rod.

In another aspect, embodiments disclosed herein relate to a jar including the following: a mandrel; an outer housing slidably disposed about the mandrel; a low pressure chamber formed between the mandrel and the outer housing; a high pressure chamber formed between the mandrel and the outer housing; and a separator. The separator may be a spring which controls fluid communication between an annulus and the jar or a pressure activated valve disposed between the low pressure chamber and the high pressure chamber.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Drilling jars are used to free stuck drill strings or to recover stuck drill string components during drilling or workover operations. The jars provide an impact blow either in the up or down directions. The driller can control the jarring direction, impact intensity and jarring times from the rig floor. The magnitude and direction of the load used to initiate the impact blow (jar) achieve this control. Examples of hydraulic jars are disclosed in U.S. Pat. Nos. 5,431,221, 5,174,393, 5,595,244, 5,447,196, 5,503,228, 5,595,253 and such patents are hereby incorporated by reference herein.

Figure 1:
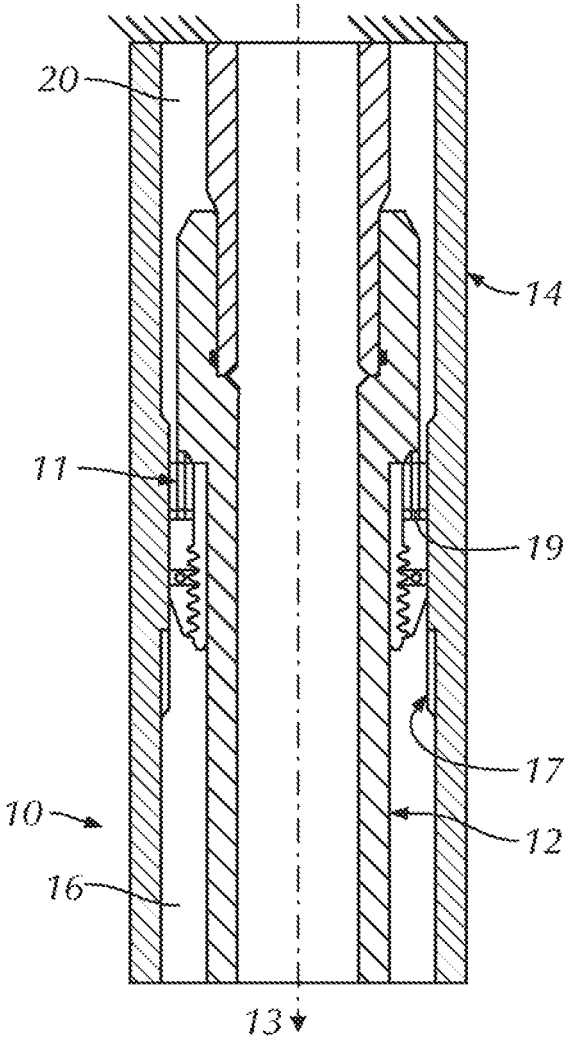
FIG. 1 illustrates a partial cross-sectional view of a drilling jar in accordance with one or more embodiments.

FIG. 1 shows a cross section through a lower detent area 11 of prior art jar 10. Downward force arrow 13 is shown and represents the force applied to mandrel 12 of jar 10. This force applied to mandrel 12 is transmitted to outer cylindrical housing 14 via detent piston 19 and results in an increase in pressure in the hydraulic fluid that is contained in lower chamber 16 between outer cylindrical housing 14 and mandrel 12.

The magnitude of the pressure in lower chamber 16 is directly proportional to the magnitude of the force applied to mandrel 12. This high-pressure fluid is allowed to flow through orifice (not shown) to an upper chamber 20. The result of this fluid flow is a relative axial movement between outer housing 14 and mandrel 12. When this relative axial movement is sufficient to place the orifice in juxtaposition to relief area 17 of outer housing 14, a sudden release of high pressure fluid occurs which results in an impact blow being delivered to the "knocker" part of the jar (not shown). The "knocker" is usually located at the upper most end portion of the drilling jar.

As explained above, during the removal of one or more jars from a wellbore, they are stored on the derrick floor in the open position with two or more drill collars above it. The weight of the drill collars and the jar itself may close the jar causing accidental firing/unintentional impact blows of the jar. Unintentional impact blows result in safety concerns for rig operators. Safety clamps are typically used to prevent this occurrence, but they present a significant falling hazard as they can be 30 to 90 ft above the floor.

Figure 2:
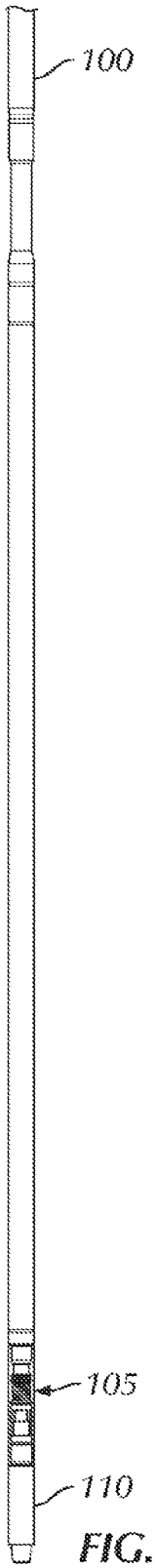
FIGS. 2 and 3 illustrate side schematic representations of drilling jars in accordance with one or more embodiments.
Figure 3:
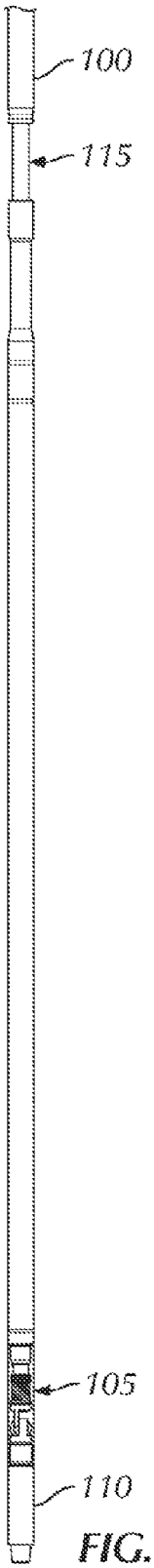

Referring to FIGS. 2 and 3, a schematic representation of a jar connected to a ball stop assembly according to one or more embodiments of the present disclosure is shown. As illustrated in FIG. 2, jar 100 is connected to a ball stop assembly 105, which is connected to a lower sub 110. FIG. 2 illustrates jar 100 fully compressed without the Kelly mandrel shaft exposed. FIG. 3 also illustrates jar 100 connected to a ball stop assembly 105, which is connected to a lower sub 110. However, in FIG. 3, jar 100 is extended with an exposed portion of Kelly mandrel shaft 115 exposed. Ball stop assembly 105 prevents unintentional impact blows, as ball stop assembly 105 acts as an internal stop that prevents axial movement of jar 100. The ball stop assembly 105 will be described in detail below.

Figure 4:
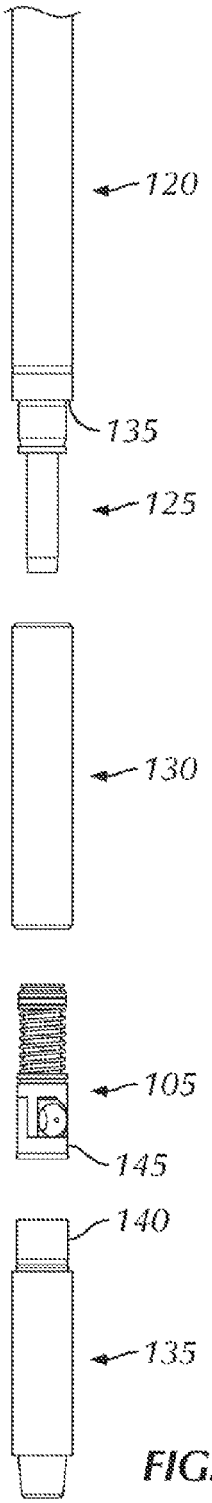
FIG. 4 illustrates a break-away side view of a ball stop assembly in accordance with one or more embodiments.

Referring to FIG. 4, a break-away schematic illustration of a ball stop assembly according to one or more embodiments of the present disclosure is shown. As illustrated, a lower jar assembly 120, having a lower mandrel 125 is disposed below a ball stop housing 130. When the tool is assembled, ball stop housing 130 slides over lower mandrel 125 into contact with lower jar assembly 120. In this embodiment, ball stop housing 130 contacts lower jar assembly 120 at a lower jar assembly shoulder 135. Depending on the specific design, ball stop housing 130 may be coupled to lower jar assembly 120 through a screw-type connection, or alternatively with bolts, rivets, or through other connections known in the art.

During assembly, a ball stop assembly 105 is disposed in ball stop housing 130. Lower sub 110 may then be coupled to ball stop housing 130 through a screw-type connection, or alternatively with bolts, rivets, or through other connections known in the art. When ball stop housing 130 is made-up with lower sub 110, a top extension 140 of lower sub 110 may contact a ball retainer 145 of ball stop assembly 105. Thus, when assembled, lower jar assembly 120 is coupled to ball stop housing 130, which is coupled to lower sub 110, such that lower mandrel 125 may communicate axially through ball stop housing 130 and ball stop assembly 105.

Figure 5:
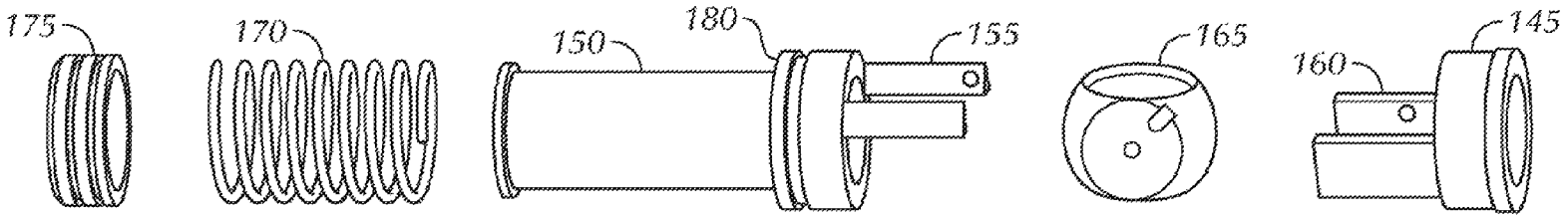
FIG. 5 illustrates a break-away view of a ball stop assembly in accordance with one or more embodiments.

Referring to FIG. 5, a break-away schematic illustration of ball stop assembly 105 according to one or more embodiments of the present disclosure is shown. In this embodiment, ball stop assembly 105 includes a spring slide 150 having yoke pins 155 extending from a lower axial portion thereof. Ball stop assembly 105 further includes a ball retainer 145 having a plurality of pivot pins 160 extending internally therein. Pivot pins 160 are configured to hold a ball stop 165, while allowing the ball stop 165 to rotate when motion applied by slide assembly 150 axially translates yoke pins 155. The axial movement of spring slide 150, and thus yoke pins 160 may thereby cause ball stop 165 to rotate about pivot pins 160. Ball stop 165, as illustrated is hollow through the center, so as to allow the lower mandrel (not shown) to move axially therethrough when the ball stop 165 is rotated into an open position. The positions of ball stop 165 will be explained in detail below.

A spring 170 is disposed around spring slide 150 and held in place with a seal 175. Seal 175 is fixed relative to spring slide 150. When assembled, the ball stop assembly 105 is disposed in the ball stop housing 130 (FIG. 4), such that an area between spring slide shoulder 180 and seal 175 (and between spring slide 150 and ball stop housing 130) is a sealed chamber filled with air.

Figure 6A:
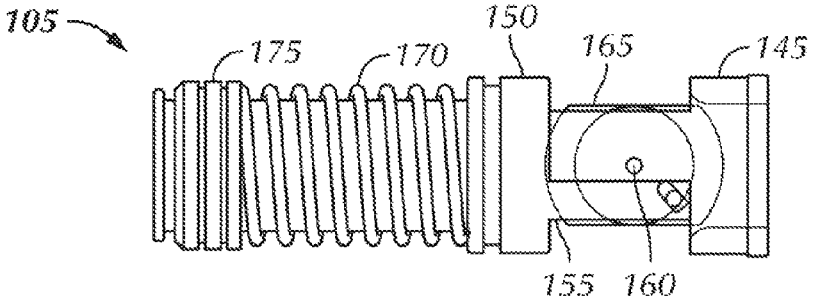
FIGS. 6A-6E illustrate operational views of a ball stop assembly transitioning between closed and open positions in accordance with one or more embodiments.
Figure 6B:
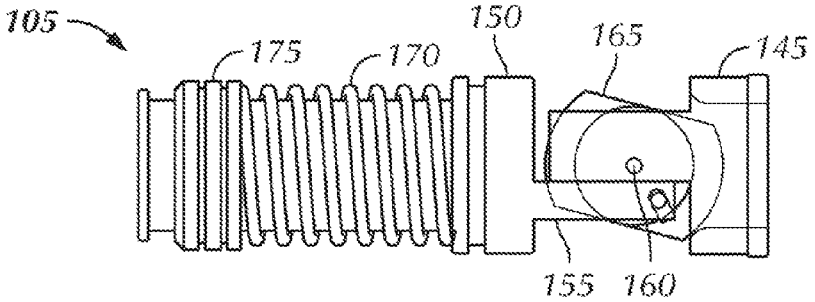
Figure 6C:
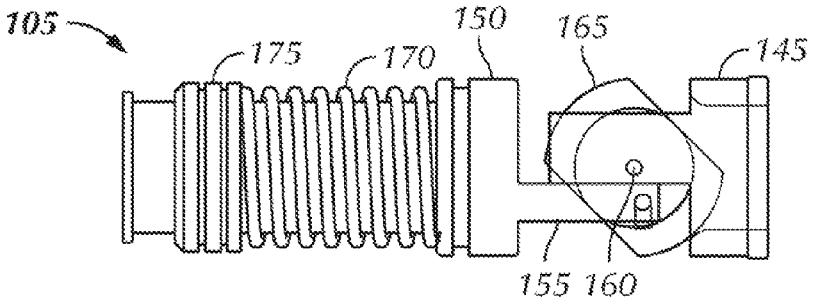
Figure 6D:
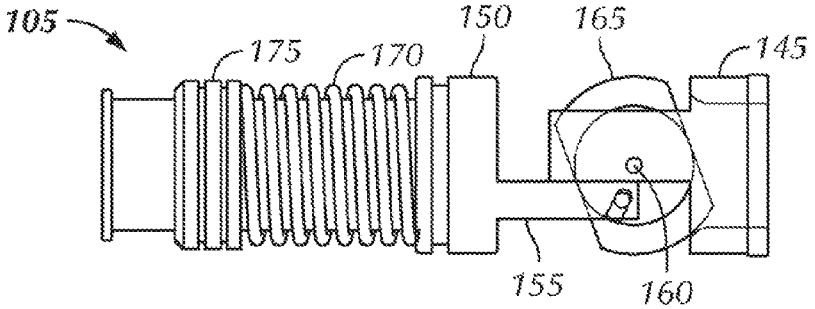
Figure 6E:
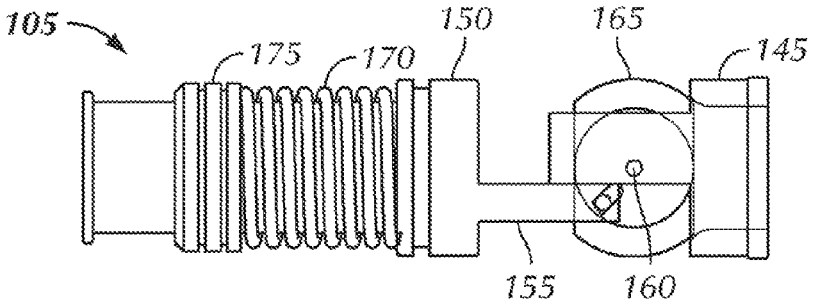

Referring to FIGS. 6A-6E, schematic representations of ball stop assembly 105 during actuation according to one or more embodiments of the present disclosure are shown. As illustrated, FIG. 6A is representative of ball stop assembly 105 in a closed, non-actuated position, while FIG. 6E is representative of ball stop assembly 105 in an open, actuated position. All of FIGS. 6A-6E show ball stop assembly 105 having a slide assembly 150 with a spring 170 disposed therearound, and sealed to form an air chamber (as disclosed above) via seal 175. Ball stop 165 is held in ball retainer 145 with pivot pins 160 and ball stop 165 is connected to yoke pins 155. Spring 170 is biased such that ball stop assembly 105 is in a closed position (as illustrated in FIG. 6A). In the closed position, ball stop 165 is oriented so that there is no internal passage through ball stop assembly 105 to allow the lower mandrel 125 (FIG. 4) of the jar to translate therethrough. However, when ball stop 165 is oriented in an open position (as illustrated in FIG. 6E), the lower mandrel 125 of the jar can freely move axially through a passage (not shown) in ball stop 165.

The ball stop 165 is rotated by converting axial movement of slide assembly 150 to rotate ball stop 165. As illustrated herein, actuation occurs as a result of a pressure differential created by the difference between the pressure of the drilling fluid and the sealed chamber of air, which is created by sealing the spring 170 via seal 175. As internal drilling fluid pressure increases, the spring assembly 150 translates axially and rotates ball stop 165 into the open position. This process is illustrated through the progression of FIGS. 6A to 6E. When drilling fluid pressure decreases, the spring 170 acts on slide assembly 150, moving slide assembly 150 in the opposite direction to rotate ball stop 165 into a closed position. This process is illustrated through the progression of FIGS. 6E to 6A. Thus, by varying the drilling fluid pressure, the ball stop assembly 105 may be rotated into open and closed positions through the drilling/jarring process. When drilling fluid pressure is ultimately decreased as the jar is removed from the wellbore, the ball stop assembly 105 will be in a closed position, such that lower mandrel (not shown) cannot pass through ball stop 165. Because lower mandrel (not shown) cannot pass through ball stop 165, the jar cannot unintentionally fire, thereby preventing safety hazards at the drilling rig.

Figure 7A:
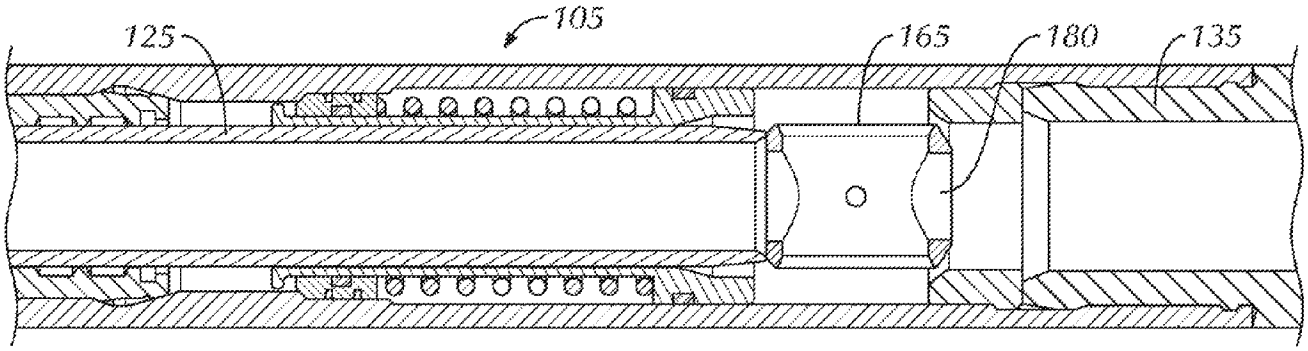
FIGS. 7A and 7B illustrate cross-sectional views of a ball stop assembly in accordance with one or more embodiments.
Figure 7B:
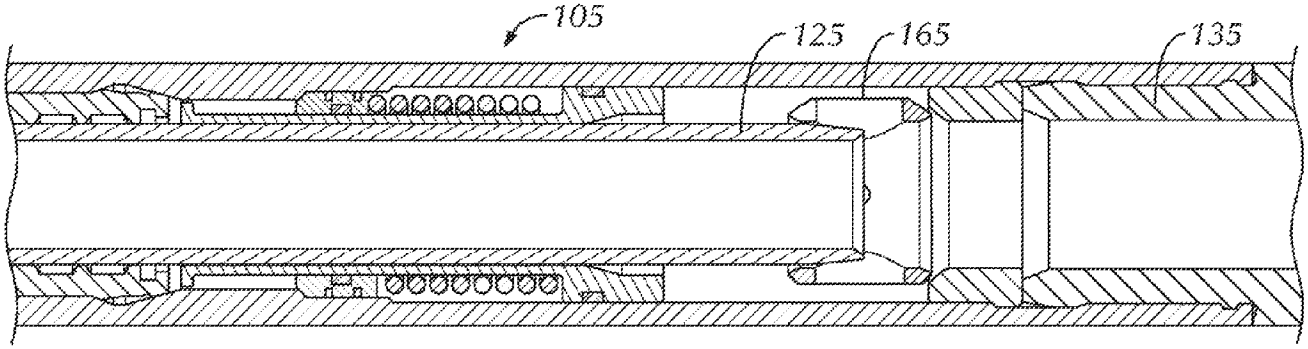

Referring now to FIGS. 7A and 7B, a cross-sectional illustration of an embodiment of the present disclosure is shown. As illustrated in FIGS. 7A and 7B, in the event of a failure of seal 175 or another component of ball stop assembly 105, fluid may still pass through ball stop assembly 105, thereby allowing drilling to continue. As illustrated in FIG. 7A, while in the closed position, lower mandrel 125 is in contact with ball stop 165, however, as the opening through ball stop 165 is smaller than the external diameter of lower mandrel 125, lower mandrel 125 cannot translate therethrough. However, because ball stop 165 includes a narrow fluid passage 180, fluid may still pass from lower mandrel 125 to lower sub 110 and on to other components of the drilling tool assembly, such as a drill bit (not shown).

As illustrated in FIG. 7B, while in an open position, lower mandrel 125 translates through ball stop 165, thereby allowing fluid communication therethrough. Thus, in the event the ball stop assembly 165 fails, fluid communication through ball stop assembly 105 is provided so as to not interfere with the drilling operation.

During operation of the jar, as explained above, the pressure generated by mud pumps allows the jar to remain in an open position due to the hydrostatic head. Thus, the tool may be operated substantially automatically, as the tool will modulate between open and closed positions as a result of the pressure generated by the mud pumps. In an alternate embodiment, modulation of the tool between open and closed positions may occur through manual actuation of a ball stop.

Figure 8A:
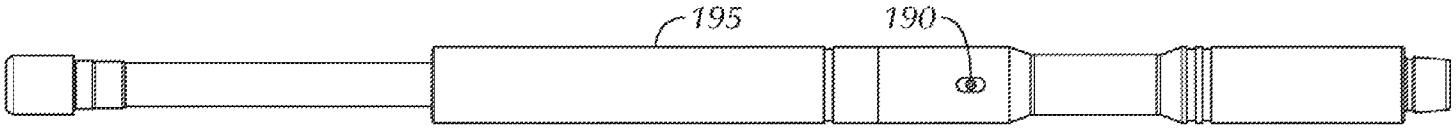
FIG. 8A illustrates a side view of a drilling jar in accordance with one or more embodiments.
Figure 8B:
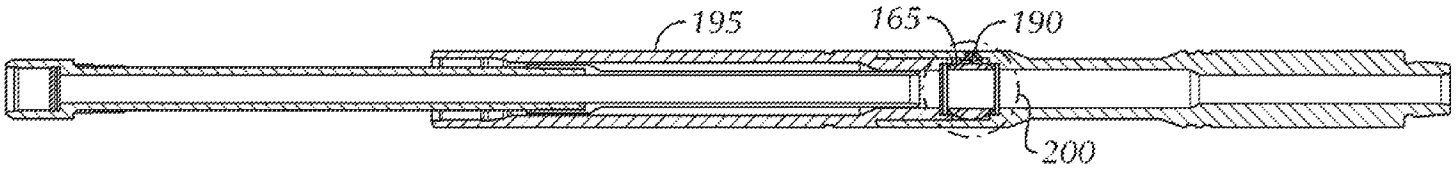
FIG. 8B illustrates a cross-sectional view of a drilling jar in accordance with one or more embodiments.
Figure 8C:
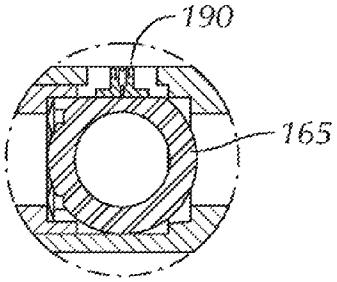
FIG. 8C illustrates a cross-sectional view of portion 200 of FIG. 8B in accordance with one or more embodiments.

Referring to FIGS. 8A-8C, a manual drilling jar locking assembly according to embodiments of the present disclosure is shown. Referring specifically to FIG. 8A, an external side view of a jar according to embodiments of the present disclosure is shown. In this embodiment, an operating stem 190 is shown extending externally from the jar 195. In order to modulate jar between a closed and open position, an operator may manually manipulate operating stem 190 to turn an internal component of jar 195.

Referring to FIGS. 8B and 8C, a cross-sectional view of FIG. 8A and a close perspective of section 200 of FIG. 8B, respectively, are shown. As illustrated, operating stem 190 is connected to a ball stop 165, such that rotation of operating stem 190 rotates ball stop 165 between an open and closed position, similar to the rotation of ball stop 165 discussed above. In this embodiment, operating stem 190 may include, for example, a screw that when turned imparts rotation to ball stop 165, thereby changing the orientation of ball stop 165 within jar 195. Those of ordinary skill in the art will appreciate that the jar may thus be modulated between open and closed positions as the jar is placed in or removed from the wellbore. Thus, the jar may be stored in a closed position, such and accidental firing cannot occur and be modulated into an open position before the jar is disposed in the wellbore.

Figure 9A:
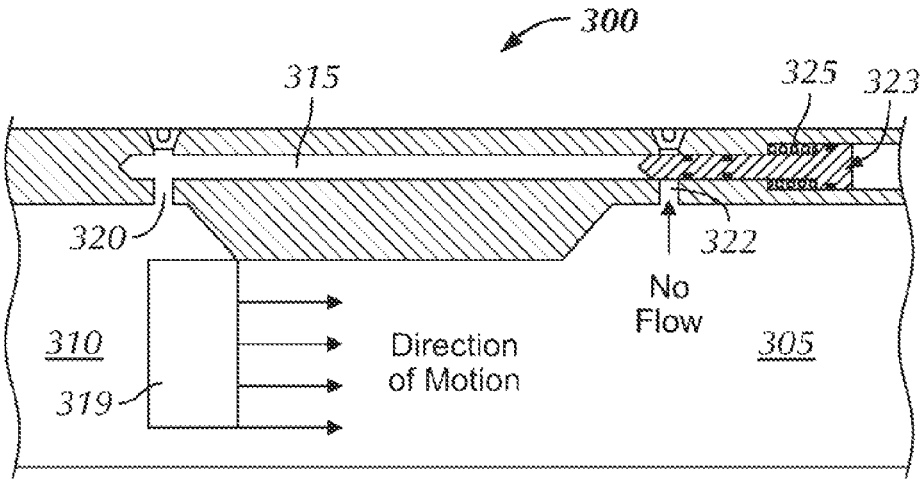
FIGS. 9A and 9B illustrate partial cross-sections of a safety bypass for a drilling jar in accordance with one or more embodiments.
Figure 9B:
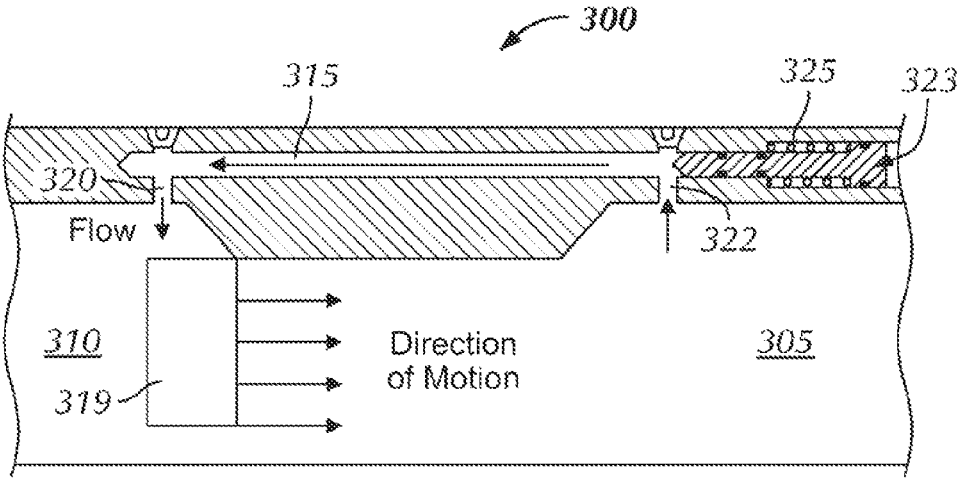

Referring to FIGS. 9A and 9B, a partial cross-section of a safety bypass for a drilling jar according to one or more embodiments of the present disclosure is shown. Specifically, FIG. 9A illustrates a jar in a closed or firing condition, while FIG. 9B illustrates the jar in an open or non-firing condition. In this embodiment, a detent section 300 (as explained above with respect to FIG. 1) of a drilling jar is shown. Detent section 300 includes a high pressure chamber 305 and a low pressure chamber 310. A fluid passage 315 provides fluid communication between high pressure chamber 305 and low pressure chamber 310. Fluid communication is provided through a first port 320 in low pressure chamber 310 and a second port 322 in high pressure chamber 305. Detent section 300 further includes a needle valve 323 disposed in fluid passage 315 and configured to translate axially within fluid passage 315.

As a drilling jar having detent section 300 is run into a wellbore, annular pressure acts on needle valve 323, causing needle valve 323 to translate axially downwardly. The axial translation of needle valve 323 within fluid passage 315 blocks second port 322, thereby preventing fluid from flowing from high pressure chamber 305 to low pressure chamber 310. Because fluid is prevented from flowing between high pressure chamber 305 and low pressure chamber 310, pressure is allowed to build within high pressure chamber 305 by the downward force of the mandrel 12 (FIG. 1) via detent piston 319, thereby allowing the jar to fire.

As the jar is removed from the wellbore, the annulus pressure decreases, thereby causing needle valve 323 to translate axially upwardly, as the spring 325 of needle valve biases the needle valve into an open condition. In an open condition, fluid is allowed to flow from high pressure chamber 305 through second port 322, into fluid passage 315, through first port 320, and into low pressure chamber 310. When the jar is in an open condition, and fluid is allowed to flow between high pressure chamber 305 and low pressure chamber 310, pressure cannot build in high pressure chamber 305, thereby preventing the jar from firing.

Those of ordinary skill in the art will appreciate that as the jar is stored in the derrick, the jar is at ambient pressure and needle valve will be biased in an open condition, thereby preventing pressure from building in high pressure chamber 305. Thus, as long as the jar remains in the derrick and stored, the jar will not unintentionally fire. As such, this embodiment of the present disclosure provides a pressure sensing device that diverts the flow of hydraulic fluid away from the pressure building detent system, thereby serving as a secondary safety mechanism when a jar is returned to the surface and placed in the derrick.

Figure 10A:
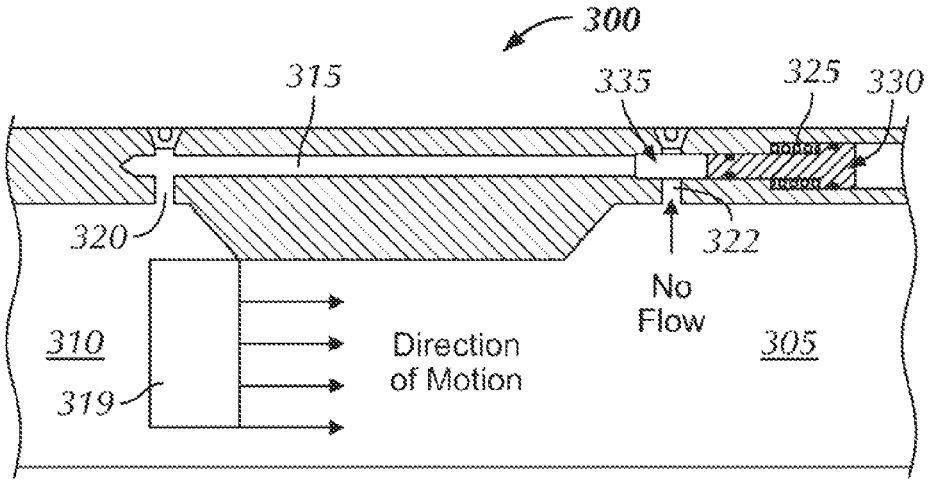
FIGS. 10A and 10B illustrate partial cross-sections of a safety bypass for a drilling jar in accordance with one or more embodiments.
Figure 10B:
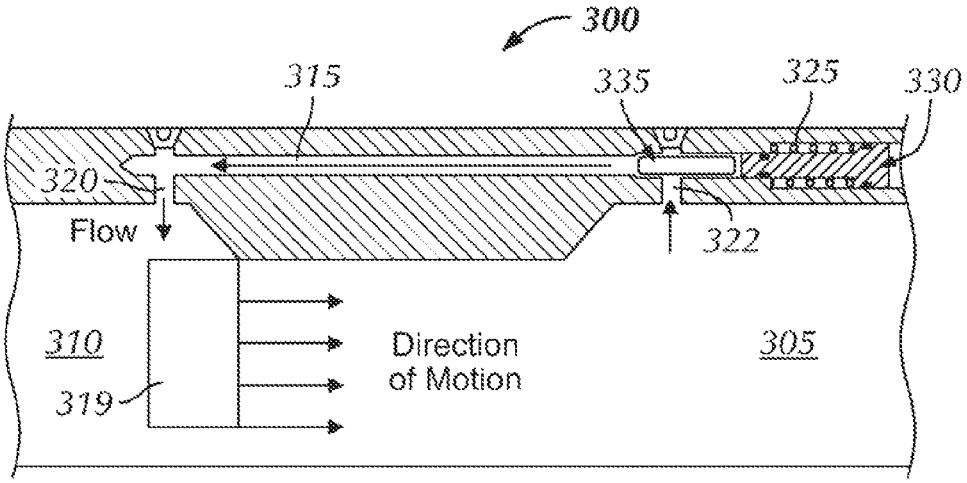

Referring to FIGS. 10A and 10B, a partial cross-section of an alternative safety bypass for a drilling jar according to embodiments of the present disclosure is shown. Specifically, FIG. 10A illustrates a jar in a closed or firing condition, while FIG. 10B illustrates the jar in an open or non-firing condition. In this embodiment a detent section 300 of a drilling jar is shown. Detent section 300 includes a high pressure chamber 305 and a low pressure chamber 310. A fluid passage 315 provides fluid communication between high pressure chamber 305 and low pressure chamber 310. Fluid communication is provided through a first port 320 in low pressure chamber 310 and a second port 322 in high pressure chamber 305. In this embodiment, a plunger 330 is disposed in fluid passage 315 and a seal rod 335 is disposed in fluid passage 315 below plunger 330 proximate second port 322.

As the jar is run into the wellbore, annulus pressure acts on plunger 330, compressing a spring 325, preventing seal rod 335 from moving axially. As temperature increases, seal rod 335 thermally expands, thereby sealing second port 322 and preventing the flow of fluid from high pressure chamber 305 through fluid passage 315 into low pressure chamber 310. Because fluid cannot flow from high pressure chamber 305 into low pressure chamber 310, pressure builds within high pressure chamber 305 by the downward force of the mandrel 12 (FIG. 1) via detent piston 319, thereby allowing the jar to fire.

When the jar is removed from the wellbore, annulus pressure decreases and a spring 325 allows plunger 330 to retract into a biased, open position. As the temperature decreases from the downhole temperatures, the seal rod 335 contracts and allows fluid to bypass from high pressure chamber 305 through fluid passage 315 and into low pressure chamber. Because fluid is allowed to flow from high pressure chamber 305 and low pressure chamber 310, pressure cannot build in high pressure chamber 305, thereby preventing the jar from unintentionally firing while the jar is stored in the derrick.

In certain embodiments, seal rod 335 may be mechanically held within fluid passage 315, thereby not requiring plunger 330. In such an embodiment, the temperature increase as the jar is run into the wellbore causes seal rod 335 to thermally expand, thereby blocking second port 322, allowing pressure to build within high pressure chamber 305, and allowing jar to fire.

Figure 11A:
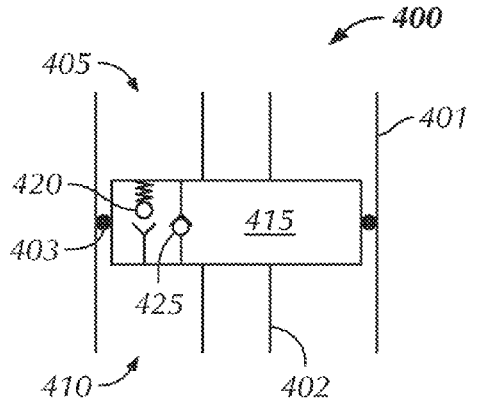
FIGS. 11A and 11B illustrate partial cross-sections of a safety bypass for a drilling jar in accordance with one or more embodiments.
Figure 11B:
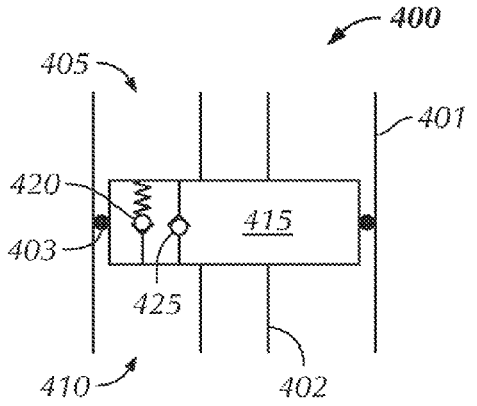

Referring to FIGS. 11A and 11B a partial cross-section of an alternate safety bypass for a drilling jar according to one or more embodiments of the present disclosure is shown. Specifically, FIG. 11A shows a jar in an open position, allowing free flow of fluids between chambers, while FIG. 11B shows a jar in a closed position, thereby not allowing the free flow of fluid between chambers.

Turning specifically, to FIG. 11A, a jar 400 is shown having an outer housing 401, a mandrel 402, pressure chamber 405 and a pressure chamber 410. A separator 415 is disposed therebetween, the separator 415 having a plurality of valves. A first valve 420, a pressure activated valve, allows fluid to flow from the pressure chamber 410 to the pressure chamber 405, while a second valve 425, a reverse free flow valve, allows fluid to only flow from pressure chamber 405 to pressure chamber 410. Jar 400 may further include a plurality of seals 403 configured to seal between separator 415 and outer housing 401.

As illustrated, first valve 420 is in the open position, thereby allowing fluid to flow freely from pressure chamber 410 to pressure chamber 405. This condition occurs as the jar 400 is run into the wellbore as a result of annulus pressure acting on first valve 420. Due to the annulus pressure, the first valve 420 is forced open, thereby allowing the free flow of fluid from pressure chamber 410 to pressure chamber 405. Because fluid may flow therebetween, mandrel 402 can move down with respect to outer housing 401 allowing the tool to go from open position (on surface) to firing position (downhole).

Referring to FIG. 11B, as the jar 400 is removed from the wellbore, there is no annulus pressure to keep first valve 420 open, thereby resulting in first valve 420 closing, preventing fluid from flowing from pressure chamber 410 to pressure chamber 405. As first valve 420 closes, the outer diameter of the separator is sealed, thereby preventing axial movement of jar 400 and effectively locking jar 400. Because jar 400 is locked, the jar cannot unintentionally fire. Those of ordinary skill in the art will appreciate that a plurality of first and/or second valves 420/425 may be used to further increase the flow rate of fluids between pressure chamber 405 and pressure chamber 410.

Figure 12A:
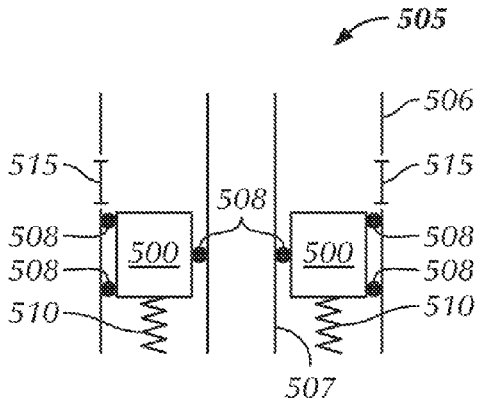
FIGS. 12A and 12B illustrate partial cross-sections of a safety bypass for a drilling jar in accordance with one or more embodiments.
Figure 12B:
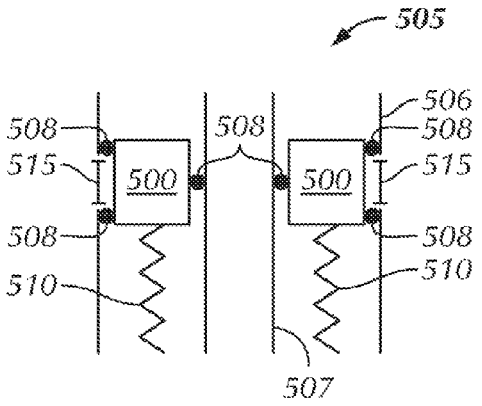

Referring to FIGS. 12A and 12B, a partial cross-section of an alternative safety bypass for a drilling jar according to one or more embodiments of the present disclosure is shown. In this embodiment, a separator 500 prevents fluid from flowing in/out of a jar 505. Jar 505 includes an outer housing 506 and a mandrel 507. A plurality of seals 508 may seal between separator 500 and outer housing 506 and between separator 500 and mandrel 507. Specifically, FIG. 12A illustrates jar 505 in an open condition, wherein fluid is allowed to flow into jar 505, thereby allowing jar 505 to be fired. FIG. 12B illustrates jar 505 in a closed condition, wherein fluid is not allowed to flow into jar 505, and as such, jar 505 cannot fire.

Referring specifically to FIG. 12A, as jar 505 is run into a wellbore, pump pressure pushes separator 500 axially downward, compressing spring 510. The compressing of spring 510 and associated axial translation of separator 500 downward opens annulus pressure communication port 515, and allows annulus pressure to keep separator 500 down, in an open position. When separator 500 is in an open condition, fluid may freely flow into and out of jar 505 as jar 505 is stroked, which is required in order for jar 505 to operate.

Referring now to FIG. 12B, as jar 505 is removed from the wellbore, annulus pressure decreases and returns to atmospheric pressure, at which point the spring 510 biases separator 500 in a closed position. As separator 500 is in a closed position, fluid cannot flow into jar 505. Because fluid cannot flow into jar 505, jar 505 is effectively hydraulically locked, thereby preventing axial movement and preventing unintentional firing. Because jar 505 is stored at atmospheric pressure in the derrick, jar 505 stored in derrick between uses cannot unintentionally fire.

Embodiments of the present disclosure may provide primary and secondary safety mechanisms for drilling jars. In certain embodiments, primary safety mechanisms may prevent axial translation of a mandrel within a jar, thereby preventing the jar from accidentally firing. In other embodiments, secondary safety mechanisms may prevent pressure from building within the detent, thereby passively preventing a jar from firing unless the jar is in the wellbore. Such primary and secondary safety mechanisms may allow drilling jars to be stored in a derrick with less risk of accidentally firing, as the jar may not be capable of building hydraulic pressure or axially translating a lower mandrel.

Multiple primary and secondary safety mechanisms may be used on a single jar, thereby further increasing the safety of the jar. For example, in certain embodiments, a primary safety mechanism preventing axial movement of the lower mandrel may be used in the same jar as a secondary safety mechanism, such as a mechanism that prevent hydraulic pressure from building in the detent. Additionally, in certain embodiments, both active and passive safety systems may be used. For example, in certain embodiments an operator may be required to manually actuate an operating stem in addition to the jar having a secondary passive safety system, such as a system to prevent hydraulic pressure from building in the detent system. Those of ordinary skill in the art will appreciate that various combinations of the safety systems disclosed herein may be combined without departing from the scope of the present disclosure.

Although only a few example embodiments have been described in detail above, those skilled in the art will readily appreciate that many modifications are possible in the example embodiments without materially departing from pressure lock for jars Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A jar comprising:
- a mandrel;
- an outer housing slidably disposed about the mandrel;
- a low pressure chamber formed between the mandrel and the outer housing;
- a high pressure chamber formed between the mandrel and the outer housing;
- a fluid passage extending between the low and high pressure chambers;
- a first port connecting the low pressure chamber to the fluid passage;
- a second port connecting the high pressure chamber to the fluid passage; and
- a valve axially movably disposed in the fluid passage, the valve selected from the group consisting of a needle valve and a seal rod.

2. The jar of claim 1, wherein the valve comprises a needle valve configured to seal the second port, thereby allowing pressure to build in the high pressure chamber.

3. The jar of claim 2, wherein the needle valve translates axially as wellbore annulus pressure increases to seal the second port.

4. The jar of claim 2, wherein the needle valve translates axially as wellbore annulus pressure decreases to permit fluid communication in the fluid passage between the first port and the second port.

5. The jar of claim 1, further comprising a plunger disposed in the fluid passage.

6. The jar of claim 5, wherein the plunger is configured to translate axially as pressure increases to cause the seal rod to close the fluid passage.

7. The jar of claim 6, wherein an increase in pressure increases the temperature in the fluid passage and the increase in temperature expands the seal rod.

8. A drilling jar comprising:
- a mandrel;
- an outer housing around at least a portion of the mandrel; and
- a safety bypass configured to lock the jar when exposed to ambient wellbore pressure, the safety bypass including:
  - a low pressure chamber radially between the mandrel and the outer housing;
  - a high pressure chamber radially between the mandrel and the outer housing;
  - a first port extending radially outward from the low pressure chamber;
  - a second port extending radially outward from the high pressure chamber;
  - a fluid passage connecting the first port and the second port; and
  - a valve within the fluid passage and configured to move axially in response to wellbore pressure.

9. The drilling jar of claim 8, the valve configured to seal the second port as wellbore annulus pressure increases, thereby allowing pressure to build in the high pressure chamber.

10. The drilling jar of claim 8, the needle configured to permit fluid flow from the second port, into the fluid passage, and to the first port as wellbore annulus pressure decreases to restrict the pressure from building in the high pressure chamber.

11. The drilling jar of claim 8, the valve including a needle valve or plunger.

12. The drilling jar of claim 8, further comprising:
- a detent piston configured to transmit force on the mandrel to the outer housing.

13. The drilling jar of claim 12, further comprising:
- a lower chamber between the housing and the mandrel, the detent piston configured to increase fluid pressure in the lower chamber in response to the force being applied to the mandrel.

14. The drilling jar of claim 13, the fluid pressure in the lower chamber being directly proportional to the force applied to the mandrel.

15. The drilling jar of claim 13, further comprising an upper chamber configured to receive fluid from the lower chamber.

16. The drilling jar of claim 15, flow of fluid from the lower chamber to the upper chamber configured to cause relative axial movement between the outer housing and the mandrel.

17. A method of locking a jar from inadvertent actuation, comprising:

tripping jar into a wellbore, the jar including a mandrel movably located within an outer housing, upper and lower chambers between the mandrel and the outer housing and configured to transfer fluid therebetween to activate the jar, and a safety bypass selectively providing fluid flow between a high pressure chamber and a low pressure chamber between the mandrel and the outer housing, through ports and a fluid passage connecting the high and low pressure chambers;

in response to increased pressure in a wellbore annulus, moving a needle valve or seal rod valve of the safety bypass within the fluid passage and thereby blocking fluid flow between the high and low pressure chambers in the safety bypass valve;

activating the jar;

tripping the jar out of the wellbore, which includes exposing the safety bypass to reduced pressure in the wellbore annulus; and in response to the pressure decreasing in the wellbore annulus, moving the valve of the safety bypass within the fluid passage and thereby enabling fluid flow between the high and low pressure chambers in the safety bypass valve.

* * * * *